US011247117B2

(12) United States Patent
Dreve

(10) Patent No.: US 11,247,117 B2
(45) Date of Patent: Feb. 15, 2022

(54) MOUTH GUARD

(71) Applicant: DREVE DENTAMID GMBH, Unna (DE)

(72) Inventor: Volker Dreve, Unna (DE)

(73) Assignee: DREVE DENTAMID GMBH, Unna (DE)

( * ) Notice: Subject to any disclaimer, the term of this patent is extended or adjusted under 35 U.S.C. 154(b) by 126 days.

(21) Appl. No.: 16/348,685

(22) PCT Filed: Jan. 8, 2018

(86) PCT No.: PCT/DE2018/100008
§ 371 (c)(1),
(2) Date: May 9, 2019

(87) PCT Pub. No.: WO2018/141325
PCT Pub. Date: Aug. 9, 2018

(65) Prior Publication Data

US 2019/0344150 A1 Nov. 14, 2019

(30) Foreign Application Priority Data

Feb. 3, 2017 (DE) ..... 10 2017 102 101.9

(51) Int. Cl.
*A63B 71/08* (2006.01)
*A63B 69/00* (2006.01)
(Continued)

(52) U.S. Cl.
CPC ..... *A63B 71/085* (2013.01); *A63B 69/0024* (2013.01); *A63B 2209/00* (2013.01)

(58) Field of Classification Search
CPC ..... A63B 71/08–085; A63B 2071/086; A63B 2071/088; A63B 69/00; A63B 69/002;
(Continued)

(56) References Cited

U.S. PATENT DOCUMENTS 3,223,085 A * 12/1965 Gores ..... A63B 71/085 128/861
3,943,924 A * 3/1976 Kallestad ..... A63B 71/085 128/861
(Continued)

FOREIGN PATENT DOCUMENTS

AT 7980 U 12/2015
FR 2576798 A 8/1986
(Continued)

*Primary Examiner* — Michelle J Lee
(74) *Attorney, Agent, or Firm* — Andrew Wilford

(57) ABSTRACT

The invention relates to a teeth protector device (1) consisting of a rail which has a U shape or a channel shape in the cross-section, is adapted to a toothed jaw (5) of a user, and is made of a deep-drawn plastic. The rail has two plastic films (3, 4) which are laminated onto each other and between which an insert (2) is located, said insert being provided in a central front region and having a lateral extension which corresponds to multiple teeth of the user and has a width that corresponds to the distance from an approximately coverable teeth tip region to the gums. The insert (2) is a molded part made of light- or laser-cured plastic using a 3D printer.

15 Claims, 2 Drawing Sheets

(51) Int. Cl.

| | |
|---|---|
| ***B29C 64/393*** | (2017.01) |
| ***B33Y 40/20*** | (2020.01) |
| ***B29C 64/10*** | (2017.01) |
| ***B29C 64/364*** | (2017.01) |
| ***B29C 64/40*** | (2017.01) |
| ***B33Y 10/00*** | (2015.01) |
| ***B33Y 50/00*** | (2015.01) |
| ***B33Y 80/00*** | (2015.01) |
| ***B29K 101/12*** | (2006.01) |

(58) Field of Classification Search

CPC ..... A63B 69/0024–0026; A63B 2209/00–18; A61F 5/56–58; A61C 7/00; A61C 7/002; A61C 7/08; A61C 19/00; A61C 19/004; A61C 19/0046; A61C 19/0053; A61C 19/06–066; A61C 9/00–0013; A61C 9/004–008; A61C 19/006; B29C 64/10; B29C 64/364; B29C 64/393; B29C 64/40; B33Y 40/20; B33Y 10/00; B33Y 50/00; B33Y 80/00; B29K 101/12

See application file for complete search history.

(56) References Cited

U.S. PATENT DOCUMENTS

| | | | | |
|---|---|---|---|---|
| 5,031,638 | A * | 7/1991 | Castaldi | A63B 71/085 128/861 |
| 5,241,921 | A * | 9/1993 | Sadlak | B63B 34/60 114/253 |
| 2003/0190575 | A1* | 10/2003 | Hilliard | A61C 7/08 433/6 |
| 2004/0154625 | A1* | 8/2004 | Foley | A63B 71/085 128/859 |
| 2006/0084024 | A1* | 4/2006 | Farrell | A63B 71/085 433/6 |
| 2007/0084471 | A1* | 4/2007 | Napoli | A63B 71/085 128/859 |
| 2008/0295850 | A1* | 12/2008 | Lesniak | A61F 5/566 128/862 |

FOREIGN PATENT DOCUMENTS

| | | | | |
|---|---|---|---|---|
| FR | 2576798 | B1 * | 5/1989 | A63B 71/085 |
| JP | 08206272 | B | 8/1996 | |

* cited by examiner

MOUTH GUARD

CROSS REFERENCE TO RELATED APPLICATIONS

This application is the US-national stage of PCT application PCT/DE2018/100008 filed 8 Jan. 2018 and claiming the priority of German patent application 102017102101.9 itself filed 3 Feb. 2017.

FIELD OF THE INVENTION

The invention relates to a mouth guard consisting of a bar of thermoplastic plastic, preferably of ethylene vinyl acetate (EVA), generally of U-section and adapted to the dentate jaw of a user, the bar having two plastic layers that are laminated onto each other and between which an insert is provided, this insert being provided particularly in a central front region and having a lateral extension that corresponds to multiple teeth of the user and has a width that corresponds to a distance from an approximately coverable tooth crown to the gingivae, as well as to a method of making a mouth guard.

BACKGROUND OF THE INVENTION

Mouth guards of the specified type are known in the art. Such mouth guards have hitherto been produced as thermoshaped parts. For manufacturing purposes, a negative mold of a dentate jaw of a corresponding patient was first formed by an impression with the aid of an impression compound. This negative mold was then filled with a pourable, curable compound, thus producing a positive model of the dentate jaw. In order to prepare the mouth guard, a first thermoplastic layer was then laid on this positive model, heated, and molded onto the positive model, preferably withy a vacuum or overpressure, so that the contours of the dentate jaw were reproduced. Subsequently or simultaneously, an additional thermoplastic layer was placed thereon that was to have the practical effect of creating an insert in the mouth guard, thus enabling them to be made materially stronger and more durable in a certain region. An additional thermoplastic layer was laid onto this insert. An additional thermoplastic operation was then carried out, so that the insert and the outer thermoplastic layer could also be applied to the positive model over the first thermoplastic layer. The combination of the individual parts thermoshaped in this manner could then be removed after cooling, thus completing the mouth guard.

The conventional design was only suitable for providing mouth guards that were very limited in terms of their shape, thickness, flexibility, and the like, both because the thickness of the insert was not able to be adjusted differently, and also because only smaller areas of the jaw to be protected in the mouth guard were able to be equipped with a corresponding insert, only the area of three teeth to the right and left of the jaw center, for example, due to the relative hardness of the material of the insert.

Such mouth guards are often used to protect athletes in particular, the mouth guard with the insert therein serving to achieve a force distribution of shocks and impacts over a larger area. Different injury patterns occur in different sports. In hockey, for example, the stick can strike a very small area with a great amount of force, unlike in boxing, where the large-surface, padded glove impacts a large area. Therefore, in order to ensure a perfect protective effect, the mouth guards must be adapted to the sport. With conventional technology, this is possible only to an insufficient extent.

Normally, layers having a thickness of 3 mm are used in prior-art mouth guards produced by thermoplastic. These thermoplastic layers are relatively elastic and have a high level of wearing comfort. As a rule, the inserts are harder and, consequently, also substantially less suitable for incorporation by the thermoplastic process. For this reason, the conventional inserts are used only in a limited region of the jaw, preferably in the front region of three teeth to the right and left of the center. A larger extension of the mouth guard is hardly possible and not common, because such deformations are difficult to achieve for larger inserts by thermoplastic.

OBJECT OF THE INVENTION

Taking this prior art as a point of departure, it is the object of the invention to provide a mouth guard of this type as well as a method of making same with the aim of providing a better protective effect, better adaptation to different sports, and better protection of the dentate jaw of the user over a greater width, i.e. not just three teeth to the right and left of the center.

SUMMARY OF THE INVENTION

To achieve this object, the invention proposes that the insert be a molded part of light- or laser-curing plastic produced by a 3D printer.

According to the invention, the insert is produced by a 3D printer, so that a 3D molded part of light- or laser-curing plastic is thus provided. This insert can be placed between the thermoplastic plastic layers, and the forming process can be carried out recessively, it not being necessary to subject the molded part produced by the 3D printer to further thermoplastic; instead, this part is introduced in its original manufactured form, size, dimension, and thickness and laid onto this layer and positioned appropriately after shaping of the inner thermoplastic plastic layer on the positive model, with the outer thermoplastic layer then being applied and thermoshaped, thus producing the complete mouth guard.

Ethylene vinyl acetate copolymer (EVA) is preferably used as the thermoplastic layers. The insert, which is a molded part produced by the 3D printer, can be adapted very easily to the corresponding application by varying the thickness of the molded part or increasing the expansion of the molded part in the longitudinal direction of the teeth or transverse thereto. In principle, there are no dimensional restrictions, because, unlike in the prior art, no deformation of the molded part by thermoplastic is required.

Especially preferably, the insert is a molded part of acrylate, methacrylate, epoxide, vinyl ether, vinyl ester, styrene derivative, thiolene, or mixtures thereof.

Such materials are light or laser-curing plastics from which individual molded parts for mouth guards can be produced in a generative process.

In addition, it may be preferred that the molded part includes a dye.

The above-described preferably processed light-curing plastics can include dyes and other initiators, so that different product generations can be identified through the use of different colors.

Especially preferably, the insert is of material of a different hardness.

The insert produced by 3D printing can easily have different degrees of hardness commensurate with the stress. The degrees of hardness can be varied in a single insert in order to provide an especially outstanding product.

Preferably, a provision is made that the insert is of material having a hardness of between 35 and 90 Shore A.

In addition, the insert has a lateral extension that corresponds to more than a width of six teeth, preferably up to 10 teeth, very preferably to the total length of a dentate jaw of a user.

The formation of the insert in the form of a 3D-printed part makes it possible to have its lateral extensions reach practically over the entire jaw to be protected. In addition, the vertical extension of the insert can reach over the crowns of the teeth or even beyond them, in which case a corresponding angled or rounded portion is provided. All of this is easily achieved by 3D printing.

Preferably the thickness of the insert is between 0.5 mm and 5 mm.

Such a thickness is varied and provided as a function of the sport practiced. Since the insert does not have to be reshaped by the thermoplastic process, a relatively thick design of up to 5 mm is possible.

The plastic layers can be at least partially opaque.

By having the plastic layers be at least partially opaque, the insert is concealed or partially or completely invisible.

The insert can have voids, depressions, and/or perforations.

This formation makes it possible to provide a mouth guard with a special design. For instance, it is possible to achieve weight reduction through voids, depressions, or perforations. The mechanical elasticity of the insert can also be influenced in a defined manner by such formations. The insert can also have such formations in the form of lattice structures, for example.

Preferably, the voids, depressions, and/or perforations can not be filled by the material of the plastic layers.

The corresponding formation ensures that the voids or the like are retained even if the other plastic layers are applied by thermoplastic, so that the desired functions of the corresponding designs are maintained even if the additional plastic layers are applied.

In particular, at least some of the voids, depressions, and/or perforations can be filled with gel.

Such a formation can be helpful in terms of improving shock absorption, for example.

In addition, preferably the plastic layers project over the insert at all edges and the plastic layers in the projecting region rest directly against and are laminated on each other.

Mechanical retention can be dispensed with by virtue of such a formation, since a secure mechanical hold is produced and a change in position can be ruled out.

In the end product, i.e. the mouth guard, the plastic layers project over the insert on all edges. These plastic layers are interconnected (only) in the projecting regions so as to lie directly on each other, thus ensuring cohesion and positional securement.

In addition, the insert preferably has at least one predetermined breaking point transverse to its longitudinal extension.

Such mouth guards can have predetermined breaking points in order to make allowances for different possible injury patterns in certain applications, i.e. specific sports. Whether and to what extent and where such a formation of predetermined breaking points makes sense must be decided on a case-by-case basis. What is essential is the fact that such predetermined breaking points can be introduced in a simple manner during the production of the molded part by 3D printer.

The insert can be of radio-opaque material, particularly one that is opaque to X-rays.

For example, the radio-opaque material can be a lead rubber material that, in contrast to the thermoplastic layers used, is X-ray opaque, i.e. visible on an X-ray image, due to its structure. If an athlete undesirably aspirates such a mouth guard, or even swallows it in an extreme case, the position of the mouth guard in the user's body can be easily rendered visible by radiological means in order to perform an emergency operation.

One special advantage is seen in the fact that the inner plastic layer that is directly against the dentate jaw has a shape that fits to a shape of the jaw and teeth, that the insert has the same shape on the side facing toward the inner plastic layer and adjoining same, and that the outer plastic layer that laid over the insert laminated on its side that is against this insert and against the projecting part over the inner plastic layer region adjoining same so as to follow the shape of the outside of the insert and of the contact surface of the inner plastic layer.

By virtue of the special method of making the mouth guard by 3D printing, it is possible to also provide the insert with such a shape on the side facing toward the inner plastic layer, which is given the shape of the dentate jaw during the thermoplastic process, with such a shape that a snug fit is achieved between the insert and the inner plastic layer. This is difficult to achieve with conventional technology.

The application of the outer plastic layer also results in an exact adaptation to the insert, so that both secure seating and excellent positional support of the parts relative to each other is achieved overall in the final state.

In addition, the plastic layers are preferably securely interconnected in the regions directly engaging each other and the molded part is positioned between the plastic layers but held so as to be slightly movable with no bond thereto.

The invention further relates to a method of making a mouth guard, particularly according to any one of claims 1 to 17, where a negative mold of a dentate jaw is formed by an impression with the aid of an impression compound, the negative mold is filled with a pourable, curable compound to produce a positive model of the dentate jaw that is preferably cured, particularly by light, and a inner thermoplastic layer is laid onto the positive model, heated, and molded onto the positive model by vacuum or overpressure, so that the contours of the dentate jaw are formed.

According to the invention, in order to produce such a mouth guard, shape data, particularly in the region onto which an insert is to be placed, are acquired by a scanner from the surface of the inner thermoplastic layer reshaped in this manner and still held by the positive model and are stored in a data logger/memory, and a 3D molded part is produced by a generative process through printing using the data retrieved from the data-storage unit and with addition of the data that are essential for the insert, such as material thickness, for example. Then the 3D molded part produced in this manner is placed as an insert onto the inner deep-drawn thermoplastic layer that is on the positive model, and then the outer thermoplastic layer is laid over the insert and the region of the inner thermoplastic layer that projects over the insert in every direction, heated, and molded by vacuum or overpressure, whereupon cooling is preferably performed and then the finished mouth guard is removed from the positive model.

A negative mold of a dentate jaw is first produced in a conventional manner by an impression and with the aid of an impression compound. This negative mold is then used to make a positive model of the dentate jaw. The inner thermoplastic layer is then laid onto this positive model, heated, and molded onto the positive model, preferably by vacuum, so that its contours are reproduced. The shape of the surface of the inner thermoplastic layer reshaped in this manner and still held by the positive model is detected by a scanner, for example, and the shape data, particularly in the region onto which an insert is to be placed, are picked up and transferred to and stored in a data logger memory. 3D molded parts can be produced by the printer by a generative process using the data retrieved from the data-storage unit with the addition of other data that are essential for the product, such as for example material thickness. A 3D molded part produced in this manner forms the insert that is laid onto the inner thermoplastic layer that is still on the positive model. Proper positioning is facilitated in that the insert is complementarily contoured on the side facing toward the inner thermoplastic layer, thus achieving proper seating through proper alignment of the contours. The outer thermoplastic layer can then be laid onto the insert and the region of the inner thermoplastic layer projecting over the insert in every direction, and then heated and molded. Cooling can be performed subsequently, including air-cooling. Once sufficient cooling has taken place, the finished mouth guard can be removed from the positive model and is usable.

Preferably, air is used as the medium for molding the thermoplastic by vacuum or overpressure The inner thermoplastic layer and the outer thermoplastic layer are securely and permanently interconnected, particularly laminated together, in the regions where the two layers directly engage each other by the vacuum or the overpressure, the material of the thermoplastic layers not bonding to the material of the insert.

The effect of this approach has already been specified in terms of the features of the mouth guard.

BRIEF DESCRIPTION OF THE DRAWING

A schematic embodiment of the invention is illustrated in the drawing and described in further detail below. In the drawing.

SPECIFIC DESCRIPTION OF THE INVENTION

Figure 1:
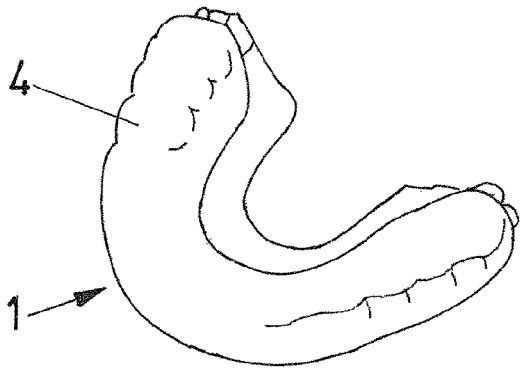
FIG. 1 is a view of a complete mouth guard.

FIG. 1 shows a complete mouth guard 1. It consists of a bar of thermoplastic plastic, particularly EVA, and approximately of U-section and shaped to fit over the dentition of a dentate jaw. The bar has two plastic layers that may be transparent and are laminated onto each other on opposite sides of an insert 2. The insert 2 has a length corresponding to a plurality of teeth of the dentate jaw and is preferably provided in a central front region of the dentate jaw facing away from the user's palate. Its width corresponds approximately to the projection of the teeth from the gingivae. The insert 2 is a molded part of light- or laser-curing plastic and produced by a 3D printer. Such an insert 2 can consist of the same material with the same hardness throughout. However, it can also consist of a different hardness from the thermoplastic layers, so that the insert 2 has a greater hardness in the middle region than in the end regions, for example. The thickness of the insert 2 can be between 0.5 mm and 5 mm, for example, and vary over the longitudinal and vertical extension. In the finished mouth guard according to FIG. 1, the plastic layers project over the insert 2 (that is no longer visible there) on all edges, the plastic layers lying directly on top of each other in the projecting region and being laminated onto each other, thereby achieving secure and solid seating and a secure interconnection of the parts.

The inner plastic layer 3 lying closest to the teeth has a shape that fits to a shape of the jaw and teeth. The insert 2 has the same shape on its side facing toward the inner plastic layer 3 and on the side resting against same. The outer plastic layer 4 that covers the insert 2 has correspondingly adapted shapes on its side resting against the insert 2 and in the projecting region on the side resting against the inner plastic layer 3, these shapes being produced by the thermoplastic process. A laminar, flush abutment of the parts against each other is this achieved and ensured. The plastic layers 1, 3 [3, 4] are securely interconnected where they lie directly on each other. The plastic layers 3, 4 project on all edges over the molded part 2 that is between the plastic layers 3, 4 but not bonded thereto.

Figure 2:
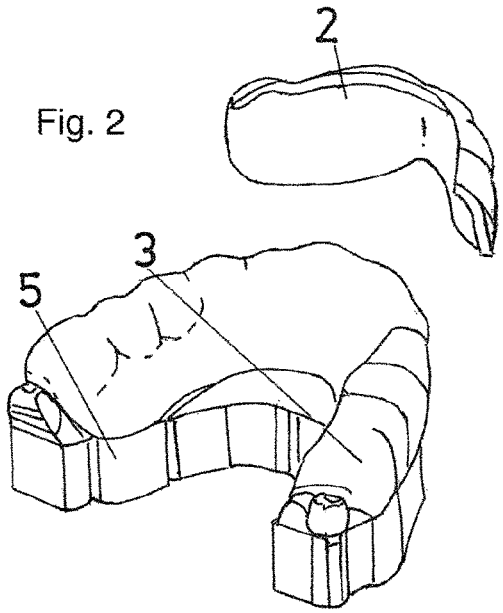
FIG. 2 is an exploded view of parts of the mouth guard according to the invention.
Figure 3:
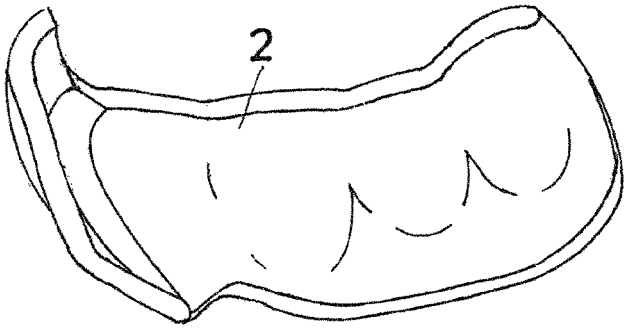
FIG. 3 shows a detail of the mouth guard.
Figure 4:
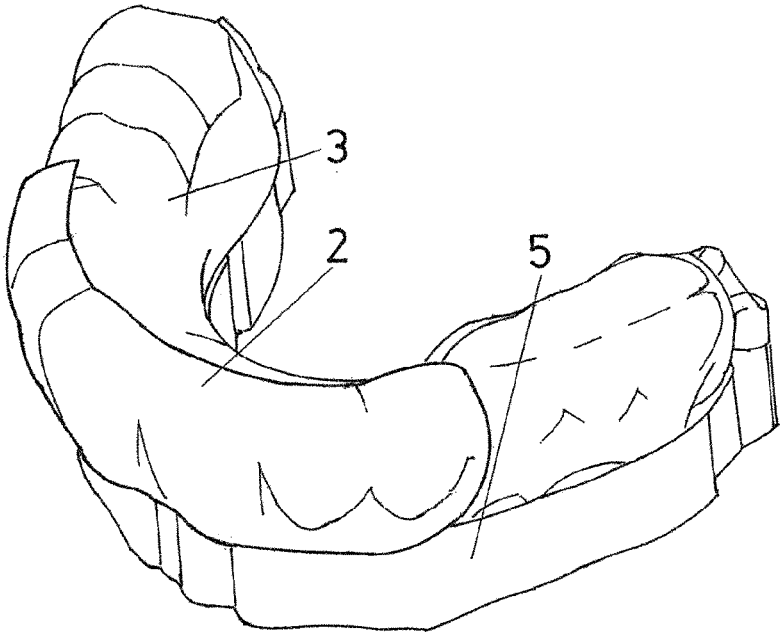
FIG. 4 is a view where the parts of FIG. 2 are joined together.
Figure 5:
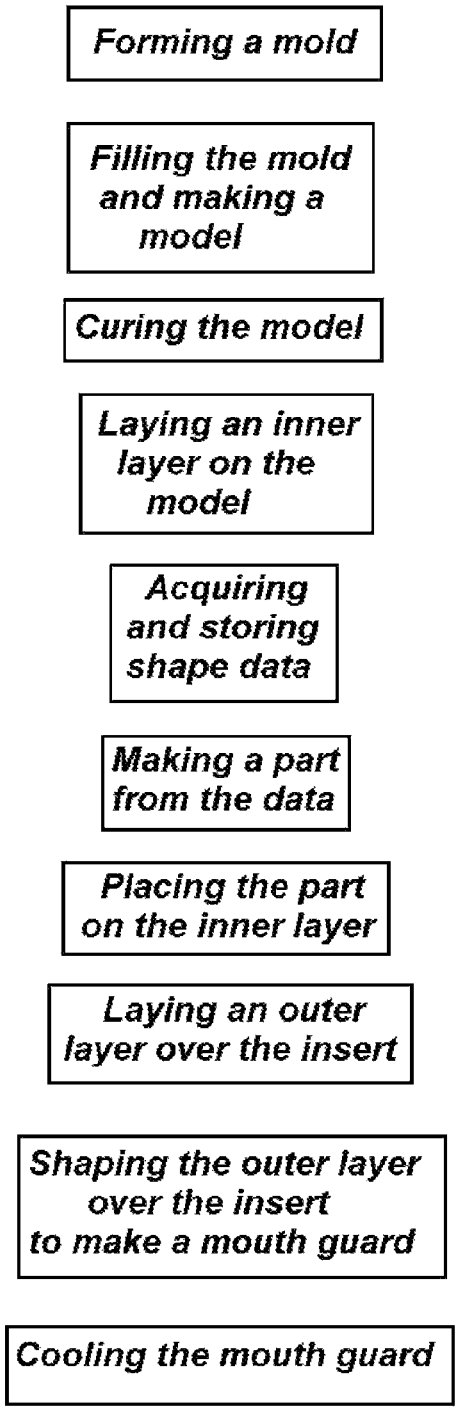
FIG. 5 is a block diagram illustrating the method of this invention.

As shown in FIG. 5, to produce such a mouth guard 1, a negative mold of a dentate jaw is first formed by an impression with the aid of an impression compound. This negative mold is filled with a pourable, curable compound, thus producing a positive model 5 of the dentate jaw. During the production process, the inner thermoplastic layer 3 is laid on the positive model 5, heated, and molded to the positive model, preferably by a vacuum as shown in the lower region in FIG. 2. The contours of the dentate jaw are reproduced in the layer. A scanner is used to detect the shape and similar essential data from the surface of the inner thermoplastic layer 3 reshaped in this manner, which is preferably still held by the positive model 5, and transferred to a data-storage unit. Additional data, for example regarding the thickness of the insert, are inputted into the data-storage unit. The molded part 2 is produced by a generative process using a 3D printer into which the data are read and processed for the purpose of production. The 3D molded part 2 produced in this manner is placed as an insert 2 onto the inner thermoplastic layer 3 on the positive model 5. The outer thermoplastic layer is laid on the insert 2 with the inner thermoplastic layer 3 projecting past the insert 2 in every direction, and then heated and molded, preferably by a vacuum. This results in a product as shown in FIG. 1.

The invention is not limited to the embodiment, but rather can be varied in many respects within the framework of the disclosure.

All of the novel individual and combined features disclosed in the description and/or drawing are regarded as being essential to the invention.

The invention claimed is:

1. A method of making a mouth guard for a dentate human jaw, the method comprising the steps of:

forming from an impression compound a negative mold of the dentate jaw by an impression, filling the negative mold with a pourable, curable compound and thereby producing a positive model of the dentate jaw, then curing the positive model, laying an inner thermoplastic layer onto the cured positive model, heating and molding the laid-on inner layer onto the positive model by vacuum or overpressure so that contours of the dentate jaw are formed, while the inner thermoplastic layer is held by the positive model, acquiring shape data of a region of a surface of the inner thermoplastic layer onto which an insert is to be placed by a scanner, and storing the scanned shape data in a data logger/memory, making a 3D molded part by a generative process through printing using the shape data retrieved from the data logger/memory;

placing the 3D molded part as the insert onto the inner thermoplastic layer on the positive model, laying an outer thermoplastic layer over the insert and an edge region of the inner thermoplastic layer that projects past the insert in every direction and heating and shaping the outer thermoplastic layer by vacuum or overpressure to form a finished mouth guard, and cooling the finished mouth guard and separating it from the positive model.

2. The method according to claim 1, wherein the insert is of a different hardness from the thermoplastic layers.

3. The method according to claim 2, wherein the insert has a hardness between 35 and 90 Shore A.

4. The method according to claim 1, wherein the insert has voids, depressions, or perforations.

5. The method according to claim 4, wherein the voids, depressions, or perforations are not filled by the thermoplastic layers.

6. The method according to claim 1, wherein the insert is molded of acrylate, methacrylate, epoxide, vinyl ether, vinyl ester, styrene derivative, thiolene system, or mixtures thereof.

7. The method according to claim 1, wherein the 3D molded part contains dye.

8. The method according to claim 1, wherein the thermoplastic layers are transparent.

9. The method according to claim 1, further comprising the step of:

configuring the insert to have a lateral extension that corresponds to more than a width of six teeth.

10. The method according to claim 1, wherein a thickness of the insert is between 0.5 mm and 5 mm.

11. The method according to claim 1, wherein the thermoplastic layers are at least partially opaque.

12. The method according to claim 1, wherein further comprising the step of:

providing the insert with at least one predetermined breaking point extending transverse to its longitudinal extension.

13. The method according to claim 1, wherein the insert is of X-ray opaque.

14. The method according to claim 1, further comprising the step of:

using air as a medium for molding by vacuum or overpressure.

15. The method according to claim 1, further comprising the steps of:

securely laminating the inner thermoplastic layer and the outer thermoplastic layer together where the two layers directly engage each other at the edge region by the vacuum or the overpressure without bonding the thermoplastic layers to the insert.

* * * * *